US006386443B1

(12) United States Patent
Szczerbinski

(10) Patent No.: US 6,386,443 B1
(45) Date of Patent: May 14, 2002

(54) COMBINATION FOOD AND CONDIMENT DISPENSER

(76) Inventor: Jeff P. Szczerbinski, 533 Rush St., Roselle, IL (US) 60172

( * ) Notice: Subject to any disclaimer, the term of this patent is extended or adjusted under 35 U.S.C. 154(b) by 0 days.

(21) Appl. No.: 09/928,111

(22) Filed: Aug. 10, 2001

(51) Int. Cl.[7] ..... B65D 21/02

(52) U.S. Cl. ..... 229/400; 220/23.4; 229/904

(58) Field of Search ..... 229/400, 902, 229/904, 906; 220/23.4, 23.83, 482; 206/541

(56) References Cited

U.S. PATENT DOCUMENTS

| | | | | | |
|---|---|---|---|---|---|
| 2,510,211 | A | | 6/1950 | Cleary | |
| 3,323,706 | A | | 6/1967 | Gereke | |
| 3,442,435 | A | * | 5/1969 | Ludder et al. | 220/23.83 |
| 3,561,644 | A | | 2/1971 | Works | |
| 4,183,444 | A | * | 1/1980 | English et al. | 220/23.4 |
| 4,854,466 | A | * | 8/1989 | Lane, Jr. | 220/482 |
| 4,955,528 | A | | 9/1990 | Schluckebier | |
| 5,429,262 | A | | 7/1995 | Sharkey | |
| D370,412 | S | | 6/1996 | Rohrer | |
| 5,540,333 | A | | 7/1996 | Gonzalez et al. | |
| D373,081 | S | | 8/1996 | Bridger | |
| 5,626,283 | A | | 5/1997 | Mellon | |
| 5,630,544 | A | | 5/1997 | Shane | |
| 5,720,429 | A | | 2/1998 | Cordle | |
| 5,776,570 | A | * | 7/1998 | Kim | 229/904 |
| 5,842,631 | A | | 12/1998 | Berger | |
| 5,875,957 | A | | 3/1999 | Yocum | |
| 6,076,700 | A | | 6/2000 | Manges | |
| 6,152,362 | A | * | 11/2000 | Rosenfeld | 229/400 |
| 6,193,201 | B1 | | 2/2001 | Babcock | |
| 6,230,969 | B1 | * | 5/2001 | Spransy | 229/904 |
| 2001/0030227 | A1 | * | 10/2001 | Fear et al. | 229/400 |
| 2001/0050283 | A1 | * | 12/2001 | Nance | 220/23.4 |

* cited by examiner

*Primary Examiner*—Gary E. Elkins
(74) *Attorney, Agent, or Firm*—Charles F. Meroni, Jr.; Meroni & Meroni, P.C.

(57) ABSTRACT

The present invention provides in combination, a food container and a condiment container. The food container includes a front panel, a back panel attached to the front panel by at least one side panel and a bottom panel for defining an enclosure therebetween. A cut-out portion is provided in the at least one side panel and is attached to the front panel and to the back panel and extends into the enclosure. The condiment container includes a top end, a bottom end, and side walls sized for placement against a side panel of the food container. A clip structure is positioned at the top end for attaching and suspending the condiment container to the at least one side panel of the food container. The cut-out portion is sized and positioned for securing the condiment container near the bottom end in coaction with the clip structure.

21 Claims, 3 Drawing Sheets

COMBINATION FOOD AND CONDIMENT DISPENSER

BACKGROUND OF THE INVENTION

1. Field of the Invention

The present invention relates generally to food and condiment containers. More specifically, the present invention is primarily intended as a combination of a stackable and nestable paperboard container with a cut-out portion and a clip-on condiment container sized for insertion through the cut-out portion in coaction with the clip-on attachment to the paperboard container.

2. Description of the Related Art

In today's fast-paced society, prepared foods found at supermarkets and particularly at "fast-food" restaurants, are extremely popular and useful. Prepared foods utilize disposable paperboard containers that are required to be stackable and nestable, one within another, either when partially or fully open. The containers must also be economical to manufacture, simple to use, and disposable after use.

With particular prepared foods, such as fried foods, vegetables, and fruits, it is often desirable to provide a condiment for dipping or scooping. In the "fast food" environment, condiments, such as ketchup, mustard, marinara sauce, and "fry sauce" are often desired for immediate consumption with french fry, onion ring, mozzarella stick, and other fried foods. The primary method for providing such condiments is in separately packaged materials and containers, or in bulk quantities where the user can pump the condiments into small cups for scooping. The user is then required to place the separately packaged condiment container in a separate location from the food container containing the prepared food where the user can then scoop the prepared food into the condiment container.

It is desirable to combine the condiment container with the food container and it becomes important for the user to be able to manage both the prepared food and the condiment with a single hand and at the same time.

In an effort to address this need, various containers have been developed over the years. Various containers have been developed with pockets placed directly on the food containers themselves for the direct and open reception of condiments therein. For example, U.S. Pat. No. 5,720,429, which issued to Cordle, discloses a paperboard food WAS container with a flip-out pocket that is operably mounted within the container mounted to a front panel, a rear panel, and to the side wall along a bottom edge. The condiment is then poured directly into the flip-out pocket. U.S. Pat. No. 4,955,528, which issued to Schluckebier, discloses a container having a first receptacle and an adjacent second fluid tight receptacle for condiments. Finally, U.S. Pat. No. 5,540,333 discloses a "dual bag" container including a primary bag for french fries coupled to a secondary bag for ketchup. The problem with these containers is that they do not allow for the interchange of condiments once they are filled, the condiments quickly become messy and are not dually contained during the eating process, and in some circumstances they place the condiment directly in the way of the user's hand when reaching for the food.

Other containers have been developed to allow for the interchange of condiments, such as the condiment container support device of U.S. Pat. No. 6,193,201 B1 that is attachable to a supporting structure for supporting a condiment container in a cantilever position outside of the food container. The condiment containers of U.S. Pat. Nos. 5,429,262 and 6,076,700 provide carry-along self-contained and supported containers that can be clipped onto the primary food containers. The problem with these containers is that they are neither protected within the food containers nor are they supported by more than their own clip structures.

It is therefore important and necessary that a combination food container and condiment container is developed that both dually contains the condiment, allows for single-handed use, minimizes the messiness of scooping and eating condiments on prepared foods, provides a means for condiment interchangeability, securely supports and protects the condiment container, is easy to manufacture, and allows for ease of use.

Other objects of my invention, as well as particular features, elements, and advantages thereof, will be elucidated in, or apparent from, the following description and the accompanying drawing figures.

SUMMARY OF THE INVENTION

The present invention provides a food and condiment container combination. According to the present invention a combination is provided and comprises a food container, a condiment container, and a clip structure. The food container includes a front panel, a back panel attached to the front panel by at least one side panel and a bottom panel for defining an enclosure therebetween. A cut-out portion is located in the at least one side panel and is attached to the front panel and to the back panel and extends into the enclosure. The condiment container includes a top end, a bottom end, and side walls sized for placement against the at least one side panel of the food container. The clip structure is positioned at the top end for attaching and suspending the condiment container to the at least one side panel of the food container. The cut-out portion is sized and positioned for securing the condiment container near the bottom end in coaction with the clip structure.

In another embodiment, the present invention provides a food container comprising:

a first container and a second container. The first container includes a first panel and a second panel positioned opposite the first panel. The first panel is folded and attached to the second panel for forming an enclosure therebetween. A cut-out structure is formed in the first panel for extending into the enclosure between the first panel and the second panel as the enclosure is formed. The second container comprises a plurality of connected walls and a detachable lid. A clip structure is attached to one of the plurality of connected walls. The second container is sized and shaped for placement within the enclosure of the first container. A bottom portion of the plurality of connected walls can be placed through the cut-out structure and the clip structure can be attached to the first panel. The cut-out structure and the clip structure therefore can coact for securing the second container inside of and to the first container.

Finally, in a further embodiment of the present invention, a container for containing food and condiments in a food-scoop type structure is provided. The container comprises a first container and a second container. The first container comprises a front wall, a back wall, and a plurality of side walls connecting the front wall to the back wall and defining an enclosure therein. A cut-out or flange structure is provided in at least one of the side walls for transversely projecting into the enclosure underlying the clip structure in vertically spaced relation in the illustrated embodiment. The second container is sized for placement within the enclosure and comprises a clip structure for attachment to one of the side walls of the first container. The cut-out or flange structure is located beneath the clip structure on the at least one side wall for holding the second container in coaction with the clip structure. In this way the first container can contain the second container. If the container were of a roundish shape or configuration, the cut-out would be configured and project inwardly from the wall of the roundish container to anchor the bottom end of a second container with ketchup or other dip. The container would have a cantilever suspension from the first container similar to the illustrated embodiment shown in the drawings all in the spirit of my invention. My first container open at its upper end and closed at its lower end for carrying a food, a plurality of side walls define an enclosure therein. A deflectable cut-out structure is provided in the container transversely and projects into the enclosure when in a deflected position located inside the enclosure, a second container is sized and shaped for placement within the enclosure, and a clip structure is provided for attachment to the first container. The cut-out structure when in the deflected position spaced beneath the clip structure co-acts with the clip structure stabilizing the second container in assembled relation within the enclosure defined by the first container.

The present invention, therefore provides a combination food container and condiment container that both dually contains the condiment, allows for single-handed use, minimizes the messiness of scooping and eating condiments on prepared foods, provides a means for condiment interchangeability, securely supports and protects the condiment container, is easy to manufacture, and allows for ease of use.

DESCRIPTION OF THE DRAWINGS

Other features of my invention will become more evident from a consideration of the following detailed description of my patent drawings, as follows.

DETAILED DESCRIPTION OF THE PREFERRED EMBODIMENT

Figure 1:
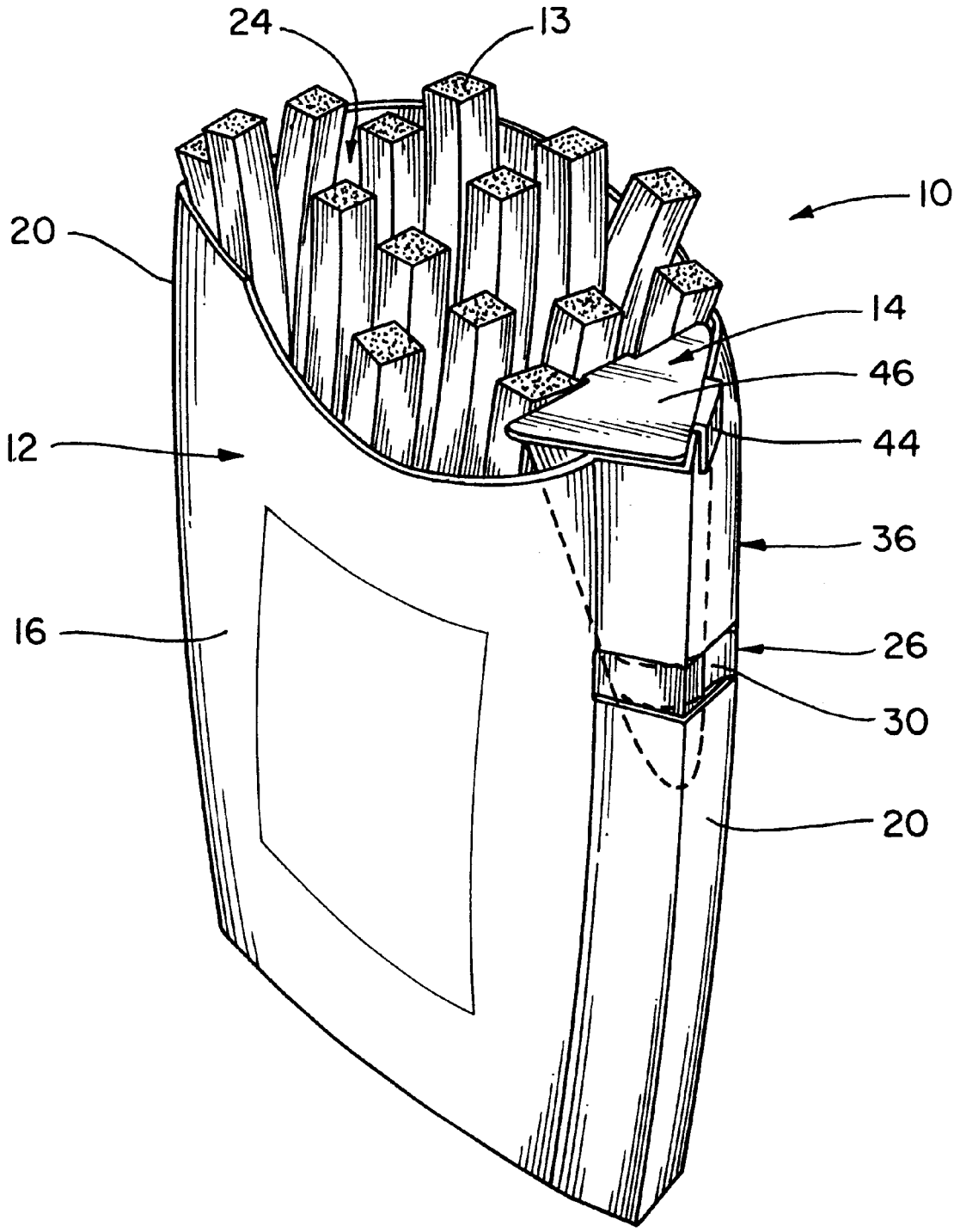
FIG. 1 is a perspective view of an embodiment of the present invention showing the combination of the food container and the condiment container in usage.

Referring now to the drawings, the present invention concerns a combination food container and condiment container, as illustrated by way of example in FIGS. 1–8. As discussed above in the Background of the Invention, it is very important to provide a combination food container and condiment container that both dually contains the condiment, allows for single-handed use, minimizes the messiness of scooping and eating condiments on prepared foods, provides a means for condiment interchangeability, securely supports and protects the condiment container, is easy to manufacture, and allows for ease of use. The present invention can provide these key features and can satisfy these needs.

It is not intended that the present invention be limited solely to fried foods and the like, rather it is intended that the scope of the present invention also includes other prepared foods, such as fruits and vegetables for use with condiments, such as mayonnaise or salad dressing.

Figure 2:
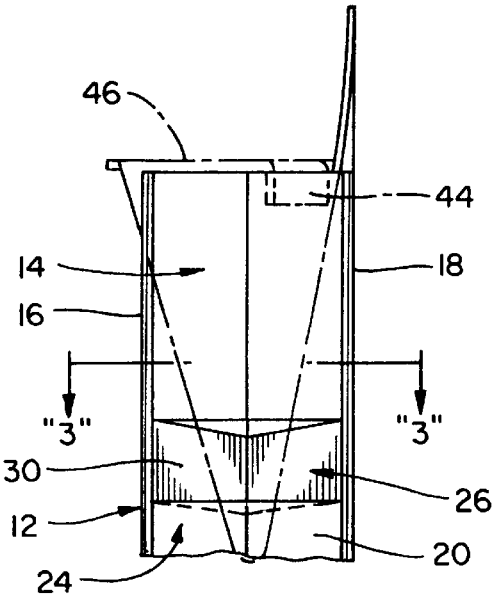
FIG. 2 is an side view of the embodiment of the present invention showing the coaction of the cut-out structure and the clip structure for securing the condiment container to the food container.
Figure 3:
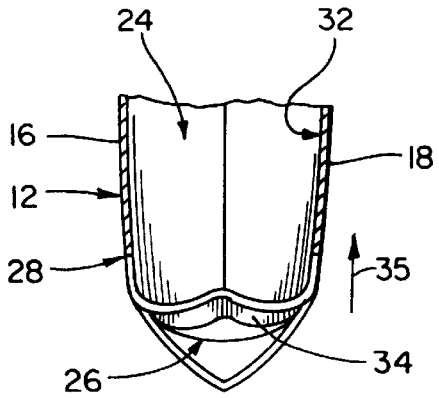
FIG. 3 is a top sectional view of the cut-out structure of the embodiment of FIG. 2 showing the extension of the cut-out structure as a loop into an enclosure between the front and back panels.
Figure 4:
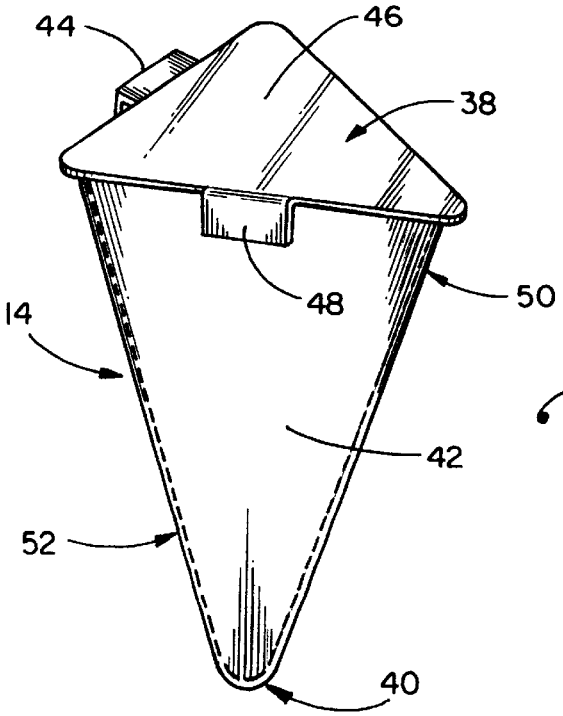
FIG. 4 is a perspective view of a condiment container of the present invention showing the triangular side walls, the clip structure, and the detachable lid.
Figure 5:
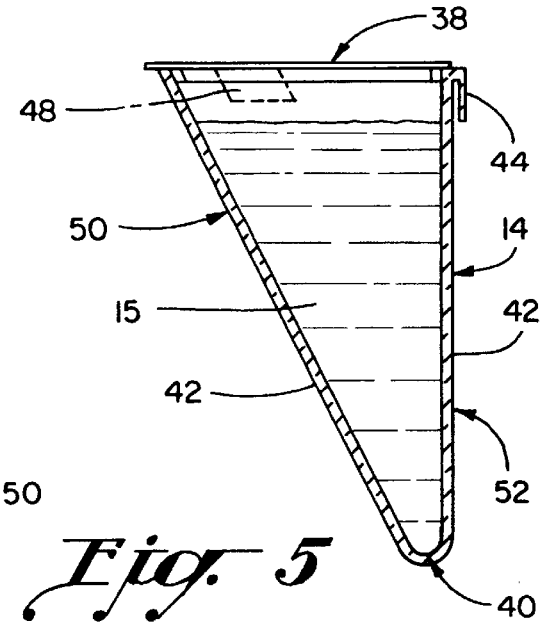
FIG. 5 is a cross-sectional view of the condiment container of FIG. 4 showing condiments contained therein.
Figure 6:
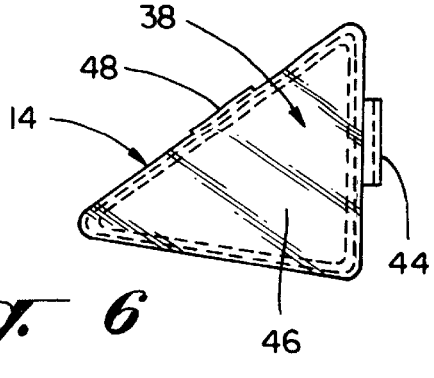
FIG. 6 is a top view of the condiment container of FIGS. 4 and 5 showing the clip structure and the lid structure.
Figure 8:
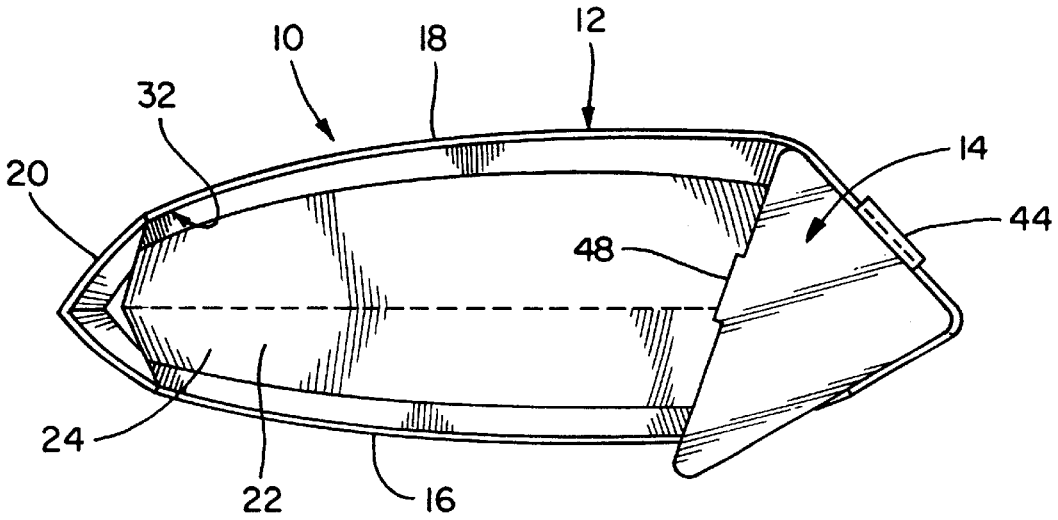
FIG. 8 is a top view of an embodiment of the present invention showing the front and back panels, the side walls, the enclosure, and the condiment container secured therein.

In a preferred embodiment, the combination food and condiment container 10 comprises a food container 12 for holding food 13 and a condiment container 14 for containing condiment(s) 15, as shown in FIGS. 1, 2, and 8. The food container 12, shown in FIGS. 1–3 and 8 comprises a front wall or panel 16, a back wall or panel 18, a plurality of side walls 20, and a bottom 22. Together, the front wall, the back wall, the side walls, and the bottom form an enclosure 24 therebetween where the food, such as the french fries shown in FIG. 1, can be contained and carried. In another embodiment of the food container, the food container can be made of a single or dual paperboard material, a treated moisture resistant paper, and or other like material where the front panel 16 can be folded and formed to fit around the back panel 18 to form the enclosure 24. It is anticipated that the food container 12 will be manufactured from paperboard or plastic materials, moisture treated materials, and so forth, although any material that satisfies the objectives of this invention is included.

An important feature of the present invention is that the food container 12 contains a cut-out structure 26 formed in either one or more of the side walls 20 or in the front panel 16 when the front panel is folded and wrapped about the back panel 18. The cut-out structure then extends into the enclosure 24, preferably in a transverse direction 35. From an outer surface 28 of the food container 12, the cut-out structure appears as a notch 30 while from an inner surface 32 of the food container, the cut-structure appears as a loop 34 or type of holster. The cut-out structure is preferably positioned among the upper half 36 of the food container 12 as shown in FIG. 1 for purposes described below. It is anticipated that the cut-out structure can be folded and cut to fold out when the food container 12 is opened from its storage or nested position or that the cut-out structure can be pressed inwards into the enclosure just as the bottom 22 is pressed inwards to lock the food container in an open position.

Figure 7:
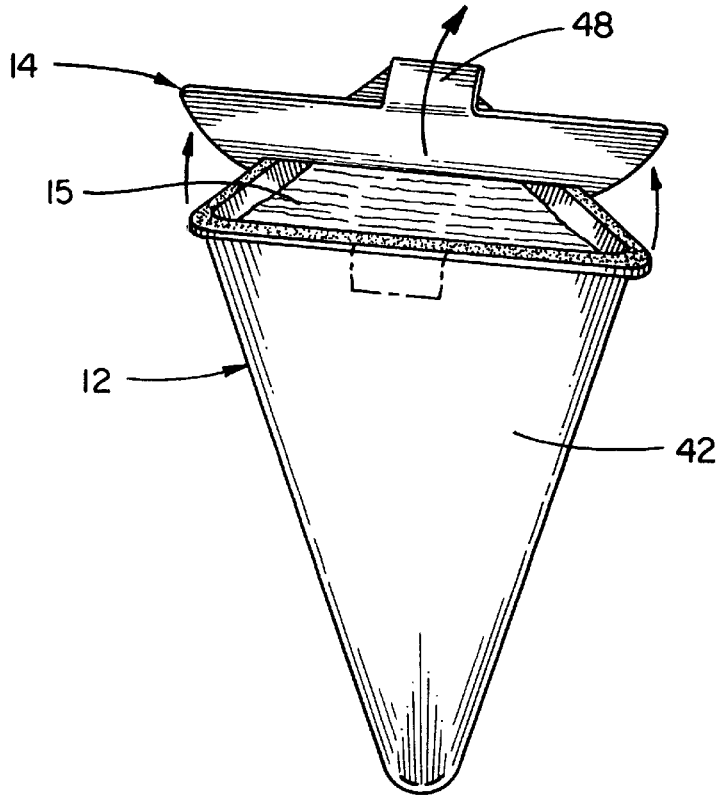
FIG. 7 is a side perspective view of the condiment container of FIG. 4 showing detachment and removal of the lid structure.

The condiment container 14, shown in FIGS. 1, 2, and 4–8 comprises a top end 38, a bottom end 40, and a plurality of connected side walls 42 that form a fluid tight structure for holding condiments and the like. The condiment container 14 also comprises a clip structure 44 that can be integrally formed with the side walls 42 or can be attached to the side walls or top end thereafter. A lid 46 is also preferably provided for sealing the condiments 15 within the condiment container. The lid can be a snap-on-and-off type of lid or an adhesively-attached and peelable type of lid, as shown in FIG. 7 with a pull tab 48 that can extend into the enclosure 24. The condiment container can be constructed of paper, plastic, or other materials known in the art and which satisfy the purposes of this invention.

In usage and in importance to the present invention, the condiment container 14 is sized and shaped for placement within the enclosure 24 of the food container 12, as shown in FIGS. 1, 2, and 8. For example, the tetrahedral shape 50 shown in FIGS. 1, 2, and 4–8 is an illustration of a shape that can conform to the inner surface 32 of the food container for creating a snug or secure fit. Other shapes that will conform to the inner surface are also included within the scope of this invention. The size and shape of the condiment container is also important in minimizing amount of food container space that is occupied while maximizing the amount of condiment provided.

Now, as is illustrated in FIGS. 1, 2, and 8, the cut-out structure 26 and the clip structure 44 coact to secure the condiment container 14 within the enclosure 24 and to the front panel 16 or side walls 20 of the food container 12. The condiment container is lowered into the enclosure 24 through the cut-out structure (i.e. the loop 34) until the side walls 42 rest against the cut-out structure (i.e. usually along a bottom half portion 52 of the side walls 42). At nearly the same time, the clip structure 44 is placed over the front panel or side walls of the food container 12 to secure the condiment container 14 to the structure of the food container. The cut-out structure is thus preferably located and sized for the condiment containers it will hold so that it encases or encompasses a portion of the condiment container while the clip structure attaches to the food container. In this way, the food container can protect and support the condiment container. In addition, the top end 38 can rest on the front panel or side walls 20 to add additional support during usage and can also extend over the front panel or side walls as shown in FIGS. 1 and 8 to ease the placement and removal of the condiment container.

The present invention thus allows for interchangeable condiment containers to be used with the same food container, for example, if the user desired to use two different types of condiments for scooping. The present invention also allows for multiple condiment containers to be used simultaneously, should a second or further cut-out structure be provided in accordance with the objectives of this invention. In addition, the cut-out structure allows for viewing the condiment containers for identification or other purposes, from another view. Moreover, the present invention allows for folding and nesting-type storage and usage of the food container including the cut-out portion, as well as ease of manufacturing as discussed above.

In construction and in use the present invention therefore provides a combination food container and condiment container that both dually contains the condiment, allows for single-handed use, minimizes the messiness of scooping and eating condiments on prepared foods, provides a means for condiment interchangeability, securely supports and protects the condiment container, is easy to manufacture, and allows for ease of use.

As various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

What is claimed is:

1. In combination, a container comprising:

a food container including a front panel, a back panel attached to the front panel by at least one side panel and a bottom panel for defining an enclosure therebetween, a cut-out portion in the at least one side panel, the cut-out portion being attached to the front panel and to the back panel and extending into the enclosure;

a condiment container including a top end, a bottom end, and side walls sized for placement against the at least one side panel of the food container; and a clip structure positioned at the top end for attaching and suspending the condiment container to the at least one side panel of the food container, the cut-out portion being sized and positioned for securing the condiment container near the bottom end in coaction with the clip structure.

2. The combination of claim 1, wherein the clip structure is integrally formed with the condiment container.

3. The combination of claim 1, wherein the clip structure is fixedly attached to the condiment container.

4. The combination of claim 1, wherein the side walls of the condiment container are triangular and are angled for alignment with the at least one side panel.

5. The combination of claim 1, wherein the condiment container further includes a lid for removable placement on the top end, the lid being a snap-on type lid for removable replacement of the lid.

6. The combination of claim 1, wherein the condiment container further includes a lid for removable placement on the top end, the lid being an adhesively-secured lid with a pull-tab for peel-away removal.

7. The combination of claim 1, wherein the food container is collapsible for storage or usage in a nesting relationship.

8. The combination of claim 7, wherein the food container is removable from the nesting relationship and foldable for forming the enclosure and for placement of the condiment container therein.

9. A food container comprising:

a first container including a first panel and a second panel positioned opposite the first panel, the first panel folded and attached to the second panel for forming an enclosure therebetween, a cut-out structure formed in the first panel for extending into the enclosure between the first panel and the second panel as the enclosure is formed;

a second container comprising a plurality of connected walls and a detachable lid; and a clip structure attached to one of the plurality of connected walls, the second container being sized and shaped for placement within the enclosure of the first container, a bottom portion of the plurality of connected walls for placement through the cut-out structure, the clip structure for attaching to the first panel, the cut-out structure and the clip structure coacting for securing the second container inside of and to the first container.

10. The food container of claim 9, wherein the cut-out structure extends into the enclosure from a side portion of the first panel for maximizing access to contents of the first container.

11. The food container of claim 10, wherein the cut-out structure forms a loop for encompassing the bottom portion of the second container and for coacting with the clip structure for attaching and securing the second container to the first container.

12. The food container of claim 9, wherein the plurality of connected walls of the second container have a tetrahedral shape and the detachable lid is a snap-on or an adhesively-attached lid.

13. The food container of claim 12, wherein the plurality of connected walls has a top portion for partial extension above and outside of the first container.

14. The food container of claim 9, wherein the clip structure and the bottom portion are removable from the first container and the cut-out structure.

15. The food container of claim 9, wherein the second container is viewable through the cut-out structure in the first container.

16. A container comprising:

a first container comprising a front wall, a back wall, and a plurality of side walls connecting the front wall to the back wall and defining an enclosure therein, a cut-out structure formed in at least one side wall of the plurality of side walls for transversely projecting into the enclosure; and a second container sized for placement within the enclosure and comprising a clip structure for attachment to one of the side walls of the first container, the cut-out structure located on the at least one side wall for holding the second container in coaction with the clip structure, the first container containing the second container.

17. The container of claim 16, where in the second container is placed into and partially through the cut-out structure and clipped onto and over the side wall housing the cut-out structure, the first container comprising a treated moisture resistant treated paper, the cut-out structure being integral in one piece with the first container.

18. The container of claim 16, wherein the cut-out structure forms a notch along an outer surface of the first container and a loop along an inner surface of the first container.

19. The container of claim 16, wherein the plurality of side walls are narrow in width and the second container is sized for fitting within the width of the plurality of side walls for securement within the enclosure, the second container further comprising a lip portion along a top portion for resting on the first container.

20. The container of claim 16, wherein the first container is a food container for food and the second container is a condiment scoop dispenser for condiments.

21. A container comprising:

a first container open at its upper end and closed at its lower end for carrying a food, a plurality of side walls defining an enclosure therein, a deflectable cut-out structure is provided in the container transversely and projects into the enclosure when in a deflected position located inside the enclosure; and a second container is sized and shaped for placement within the enclosure, and a clip structure is provided for attachment to the first container, the cut-out structure when in the deflected position spaced beneath the clip structure and co-acting with the clip structure stabilizing the second container in assembled relation within the enclosure defined by the first container.

* * * * *